US007114630B2

(12) United States Patent
Dege et al.

(10) Patent No.: US 7,114,630 B2
(45) Date of Patent: Oct. 3, 2006

(54) TRAY LID

(75) Inventors: Paul T. Dege, Grandville, MI (US); Jim C. Nensewitz, Grand Rapids, MI (US)

(73) Assignee: Oliver Products Company, Grand Rapids, MI (US)

( * ) Notice: Subject to any disclaimer, the term of this patent is extended or adjusted under 35 U.S.C. 154(b) by 67 days.

(21) Appl. No.: 10/222,569

(22) Filed: Aug. 16, 2002

(65) Prior Publication Data

US 2004/0031799 A1 Feb. 19, 2004

(51) Int. Cl.

| | |
|---|---|
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |

(52) U.S. Cl. ..... 220/526; 220/523

(58) Field of Classification Search ..... 220/523, 220/526, 4.21, 783, 793; 206/561
See application file for complete search history.

(56) References Cited

U.S. PATENT DOCUMENTS

| | | | | |
|---|---|---|---|---|
| 1,020,004 | A | | 3/1912 | Wishman |
| 1,215,724 | A | | 2/1917 | Shaffer |
| 2,272,178 | A | | 2/1942 | McDowell et al. |
| D189,979 | S | | 3/1961 | Mengel |
| 3,101,864 | A | | 8/1963 | Glickman |
| 3,228,776 | A | | 1/1966 | Savage et al. |
| 3,275,329 | A | | 9/1966 | Lieberman et al. |
| 3,452,896 | A | | 7/1969 | Elliot |
| 3,595,425 | A | | 7/1971 | Eicholtz et al. |
| D222,035 | S | | 9/1971 | Cyr |
| 3,609,263 | A | * | 9/1971 | Clementi ..... 220/792 |
| 3,633,785 | A | | 1/1972 | Cyr et al. |
| 3,817,420 | A | * | 6/1974 | Heisler ..... 220/790 |
| 3,845,875 | A | | 11/1974 | Douglas et al. |
| D235,499 | S | | 6/1975 | Day |
| D236,691 | S | | 9/1975 | Haase |
| D236,692 | S | | 9/1975 | Haase |
| 3,912,118 | A | | 10/1975 | Bird |
| 3,989,142 | A | | 11/1976 | Gwilliam, Jr. et al. |
| 4,081,646 | A | | 3/1978 | Goltsos |
| 4,146,170 | A | | 3/1979 | Medendorp |
| 4,190,155 | A | | 2/1980 | Higley |
| 4,235,340 | A | | 11/1980 | Clack et al. |
| 4,376,493 | A | | 3/1983 | Gall |
| 4,412,630 | A | | 11/1983 | Daenen |
| 4,428,493 | A | | 1/1984 | McDonough |
| 4,555,043 | A | * | 11/1985 | Bernhardt ..... 220/783 |
| 4,660,716 | A | | 4/1987 | McMahon et al. |
| 4,838,444 | A | | 6/1989 | Bitel |
| 5,027,972 | A | | 7/1991 | Bartholomew |
| D348,608 | S | | 7/1994 | Wyslotsky |
| 5,356,026 | A | | 10/1994 | Andress et al. |
| D374,819 | S | | 10/1996 | Wells |
| D376,953 | S | | 12/1996 | Dunn |

(Continued)

*Primary Examiner*—Nathan J. Newhouse
*Assistant Examiner*—Harry Grosso
(74) *Attorney, Agent, or Firm*—Price, Heneveld, Cooper, DeWitt & Litton, LLP

(57) ABSTRACT

A tray lid for covering a food tray having at least one food pocket therein. The tray lid includes a substantially flat tray covering section including a wall covering portion and at least one pocket covering portion formed thereon. The tray lid can include at least one pocket covering portion having a peripheral channel configured to abut against an associated wall of a food pocket of the food tray to seal food within the at least one food pocket.

19 Claims, 4 Drawing Sheets

U.S. PATENT DOCUMENTS 5,604,130 A 2/1997 Warner et al.
5,624,051 A 4/1997 Ahern, Jr. et al.
D389,057 S 1/1998 Hayes et al.
5,730,313 A * 3/1998 Hayes et al. ..... 220/526
5,762,231 A 6/1998 Rider, Jr. et al.
5,915,581 A 6/1999 Pfirrmann, Jr. et al.
RE36,867 E 9/2000 Rozzano
6,170,696 B1 1/2001 Tucker et al.
6,467,647 B1 * 10/2002 Tucker et al. ..... 220/793

* cited by examiner

TRAY LID

BACKGROUND OF THE INVENTION

This invention relates to food carriers, and in particular to a food tray and tray lid of a food carrier.

Food carriers are used extensively for transporting food from one location to another location. One example of a food carrier is the food carrier used in transporting food products from a grocery store or restaurant to the location where the food is to be consumed. The same food carrier can also be used to transport hot or cold food to people who are not able to leave their homes.

Heretofore, food carriers have included compartmentalized containers having a food tray and a tray lid. The food tray included a plurality of food pockets wherein food was placed into the food pockets and the tray lid was placed over the food tray to prevent the food from spilling when the food carrier is transported from one location to another location. However, tray lids have typically included a flat planar surface that covered all of the food pockets in the food tray. Therefore, food in one food pocket has leaked into another food pocket when the food carrier is transported or when the food carrier experiences bending or other force applied to the food carrier. This commingling of food can be particularly unfavorable when a hot food in one food pocket is mixed with cold food in another pocket, thereby lowering and/or raising, respectively, the temperature of the food. Additionally, the tray lids with the flat planar surface have been subject to bending and therefore can be damaged very easily.

Accordingly, a food carrier having a tray lid solving the aforementioned disadvantages and having the aforementioned advantages is desired.

SUMMARY OF THE INVENTION

One aspect of the present invention is to provide a tray lid for covering a food tray having at least one food pocket therein. The tray lid includes a substantially flat tray covering section including a wall covering portion and at least one pocket covering portion formed thereon. The pocket covering portion has a central area and a periphery defined by a channel. The central area of the pocket covering portion and the wall covering portion are substantially parallel. The channel includes a first side wall connected to the wall covering portion, a second side wall connected to the central area of the pocket covering portion and a connection portion connecting the first side wall and the second side wall. A bottom face of the wall covering portion is adapted to overlie a top flat portion of a wall of the at least one food pocket of the tray and the first side wall of the channel is adapted to partially overlie a slanted portion of the wall of the at least one food pocket of the tray, thereby securely maintaining food in the at least one food pocket of the food tray when the tray lid is placed over the food tray.

Another aspect of the present invention is to provide a food carrier assembly comprising a food tray and a tray lid. The food tray includes at least one food pocket therein. The food tray further includes a wall having a slanted portion defining sides of the at least one food pocket and a top flat portion defining a top of the food tray. The tray lid covers the food tray, and includes a substantially flat tray covering section having a wall covering portion and at least one pocket covering portion formed thereon. The pocket covering portion has a central area and a periphery defined by a channel. The central area of the pocket covering portion and the wall covering portion are substantially parallel. The channel has a first side wall connected to the wall covering portion, a second side wall connected to the central area of the pocket covering portion and a connection portion connecting the first side wall and the second side wall. A bottom face of the wall covering portion overlies a top flat portion of the wall of the food tray and the first side wall of the channel partially overlies a slanted portion of the wall of the food tray when the tray lid is placed over the food tray, thereby securely maintaining food in the at least one food pocket of the food tray when the tray lid is placed over the food tray.

Accordingly, the food carrier assembly and the tray lid provide for secure transport of the food within the food tray. The food carrier assembly and the tray lid are efficient in use, economical to manufacture, capable of a long operable life, and particularly adapted for the proposed use.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 1:
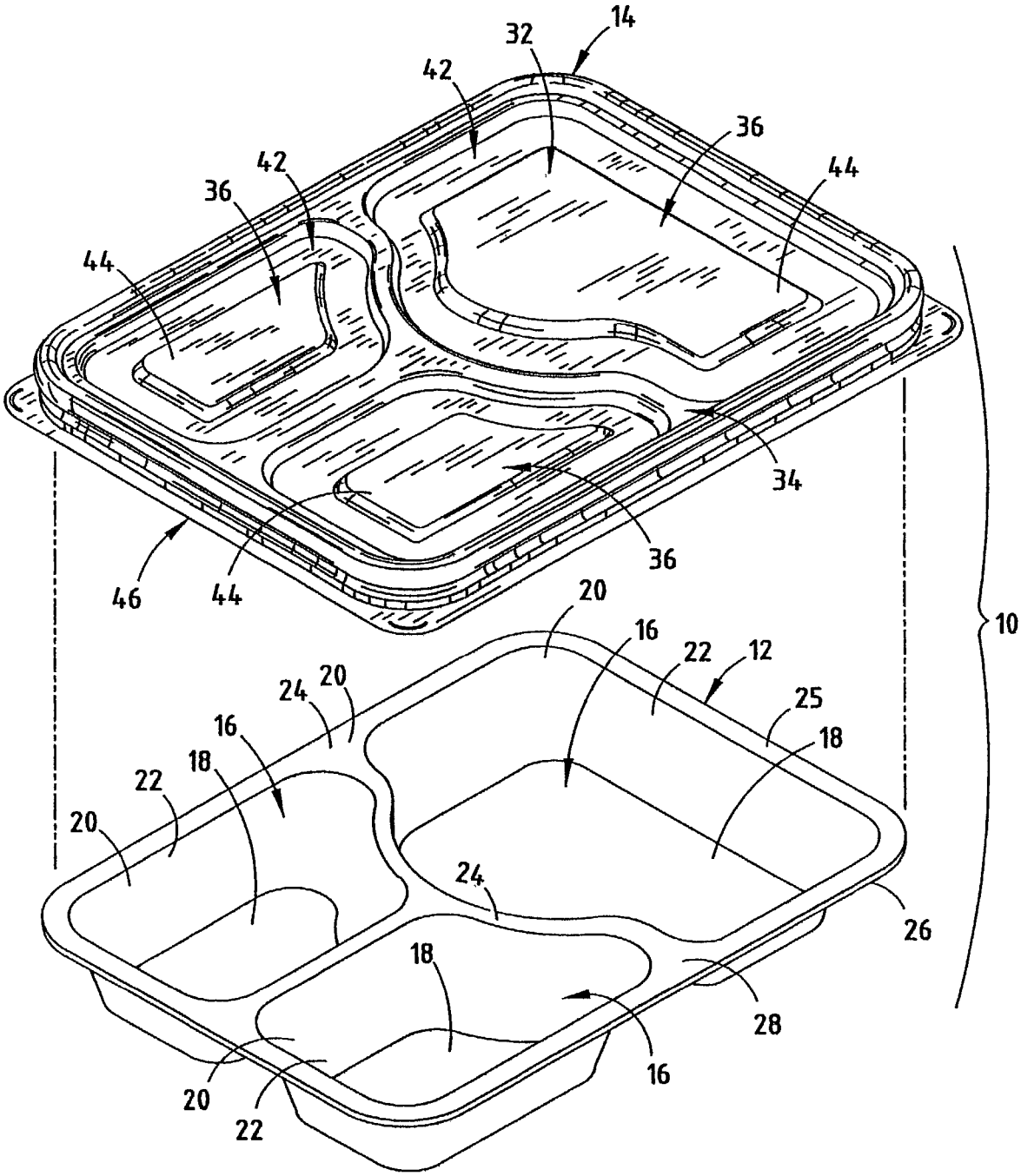
FIG. 1 is an exploded perspective view of a tray and a tray lid of the present invention.
Figure 2:
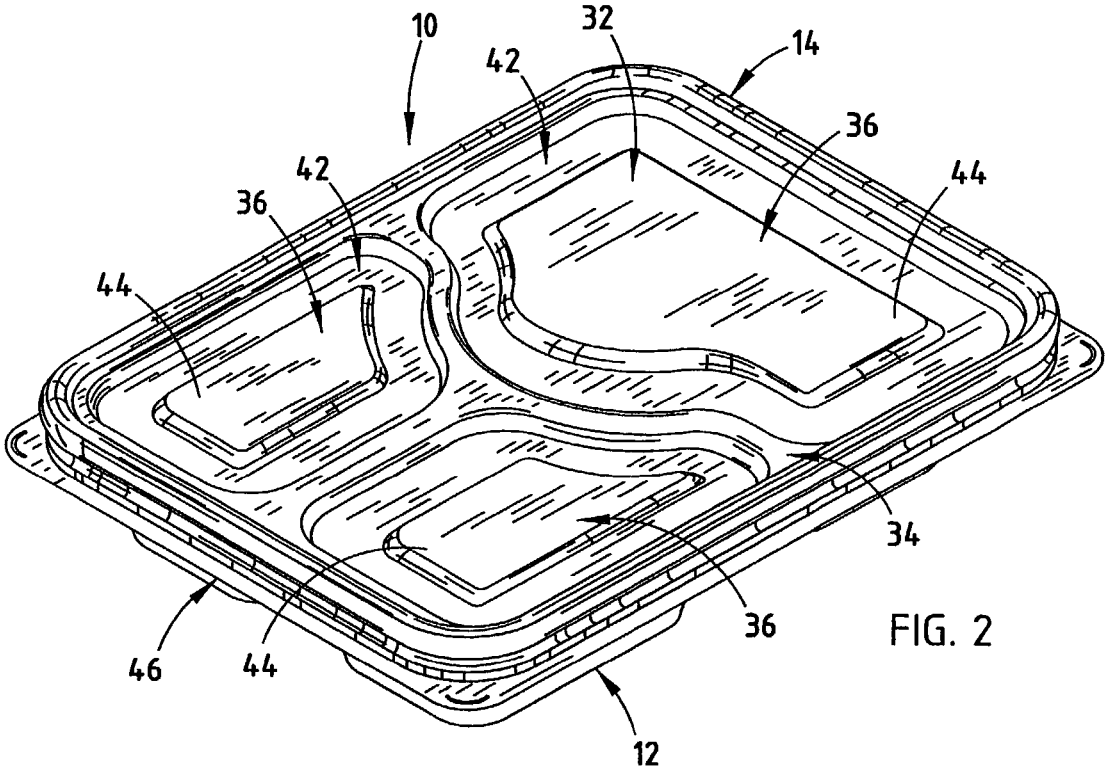
FIG. 2 is a perspective view of the tray and tray lid of the present invention.
Figure 3:
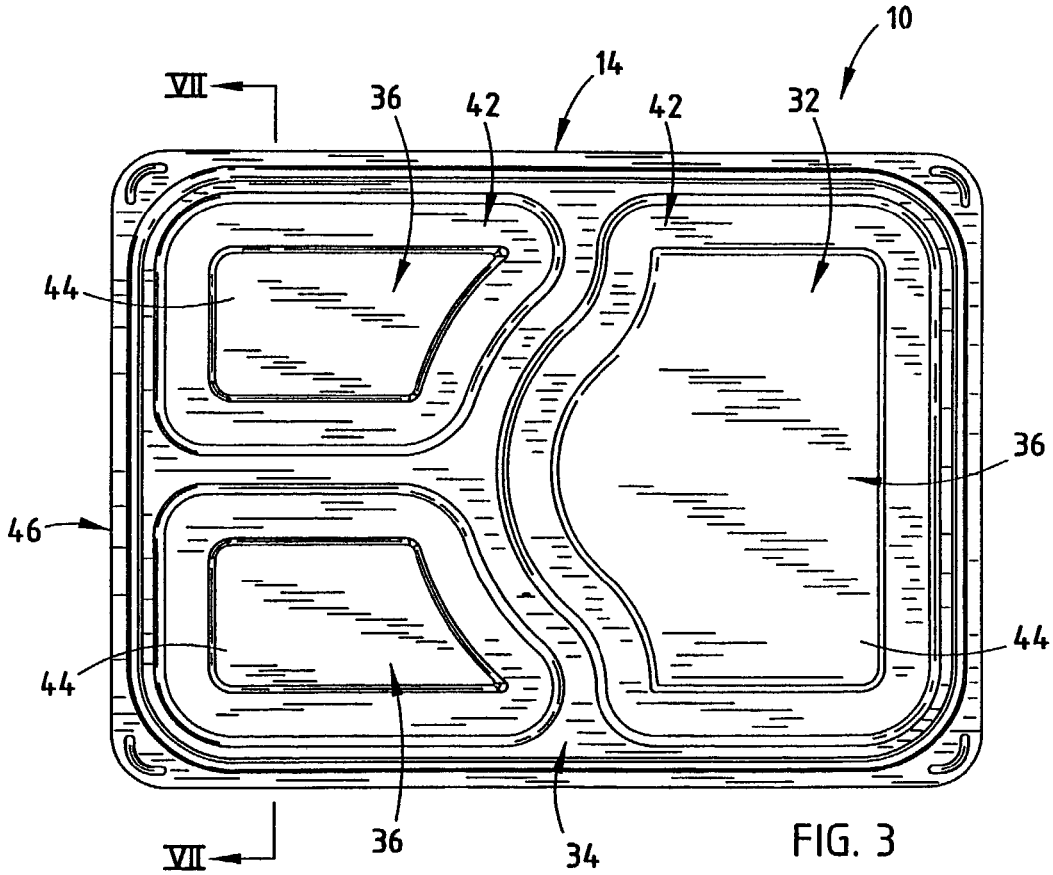
FIG. 3 is a top view of the tray and tray lid of the present invention.
Figure 4:
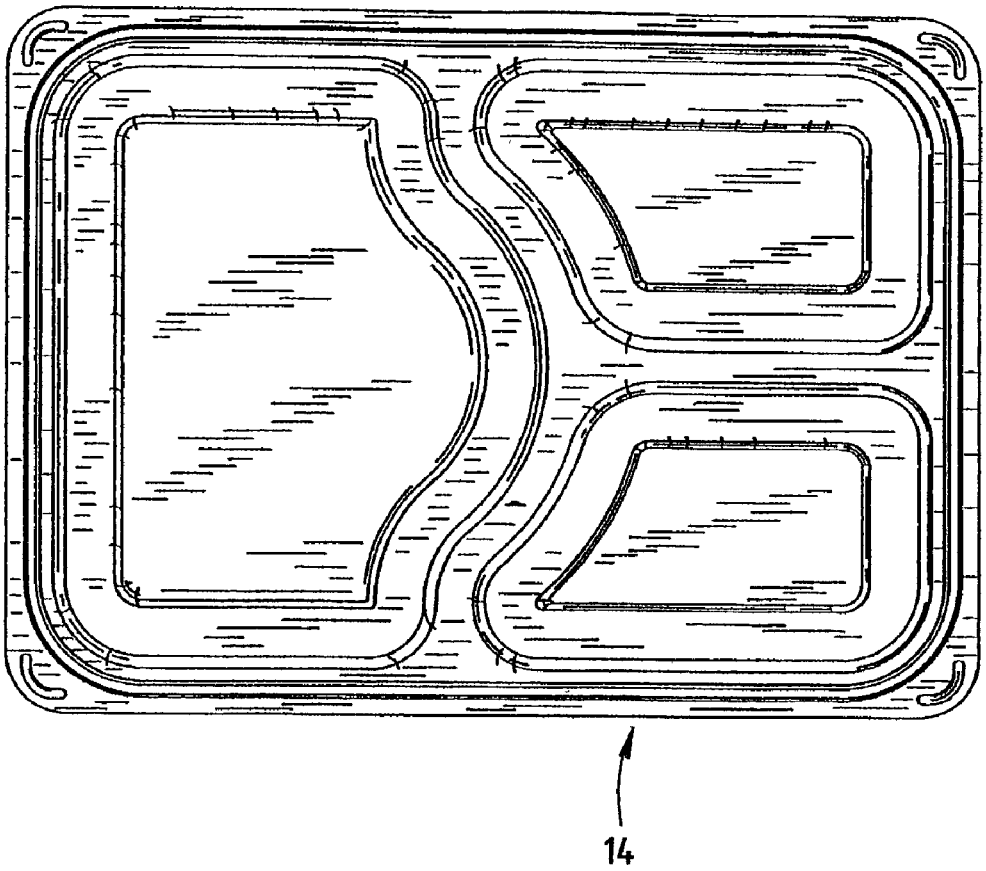
FIG. 4 is a bottom view of the tray lid of the present invention.
Figure 5:
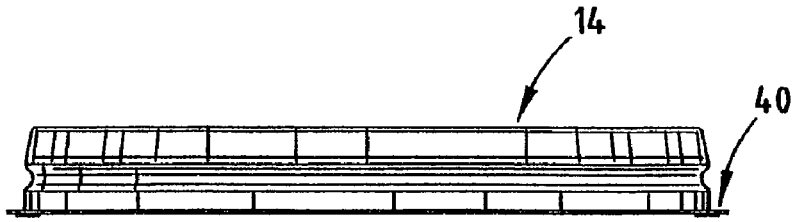
FIG. 5 is a front view of the tray lid of the present invention, the rear view being a mirror image thereof.
Figure 6:
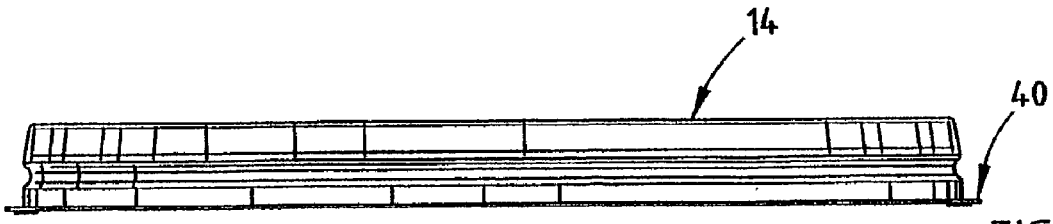
FIG. 6 is a left view of the tray lid of the present invention, the right side view being a mirror image thereof.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, reference number 10 generally designates a food carrier assembly embodying the present invention. In the illustrated example, the food carrier assembly 10 includes a food tray 12 and a tray lid 14. The food tray 12 includes a plurality of food pockets 16 for accepting food therein. In the illustrated example, the food tray 12 includes three food pockets 16, although it is contemplated that any number of food pockets 16 can be used in the food tray 12. The food tray 12 can be used to transport cold or hot food within the food pockets 16. The food tray 12 can be made out of paper, plastic or any other material known to those skilled in the art. The tray lid 14 is placed over the tray lid 12 to cover the food pockets 16 to thereby maintain the food within the food pockets 16 and to maintain the temperature of the food within the food pockets 16.

In the illustrated example, the food tray 12 (FIGS. 1–3 and 7) is substantially rectangular and includes the three food pockets 16. The food pockets 16 are defined by a bottom surface 18 and a wall 20. The wall 20 includes a slanted portion 22 connected to the bottom surface 18 and a flat top portion 24 at the top of the slanted portion 22 defining a top of the food tray 12. Food is held in the food tray 12 within the food pockets 16 by the bottom surface 18 and the slanted portion 22 of the wall 20. The food tray 12 also includes a flat rim 25 extending outward from the food pockets 16. The flat rim 25 includes an edge 26, a top surface 28 and a bottom surface 30. As explained in more detail below, the flat rim 25 assists in connecting the tray lid 14 to the food tray 12. The food tray 12 as described above is well known to those skilled in the art.

Figure 7:
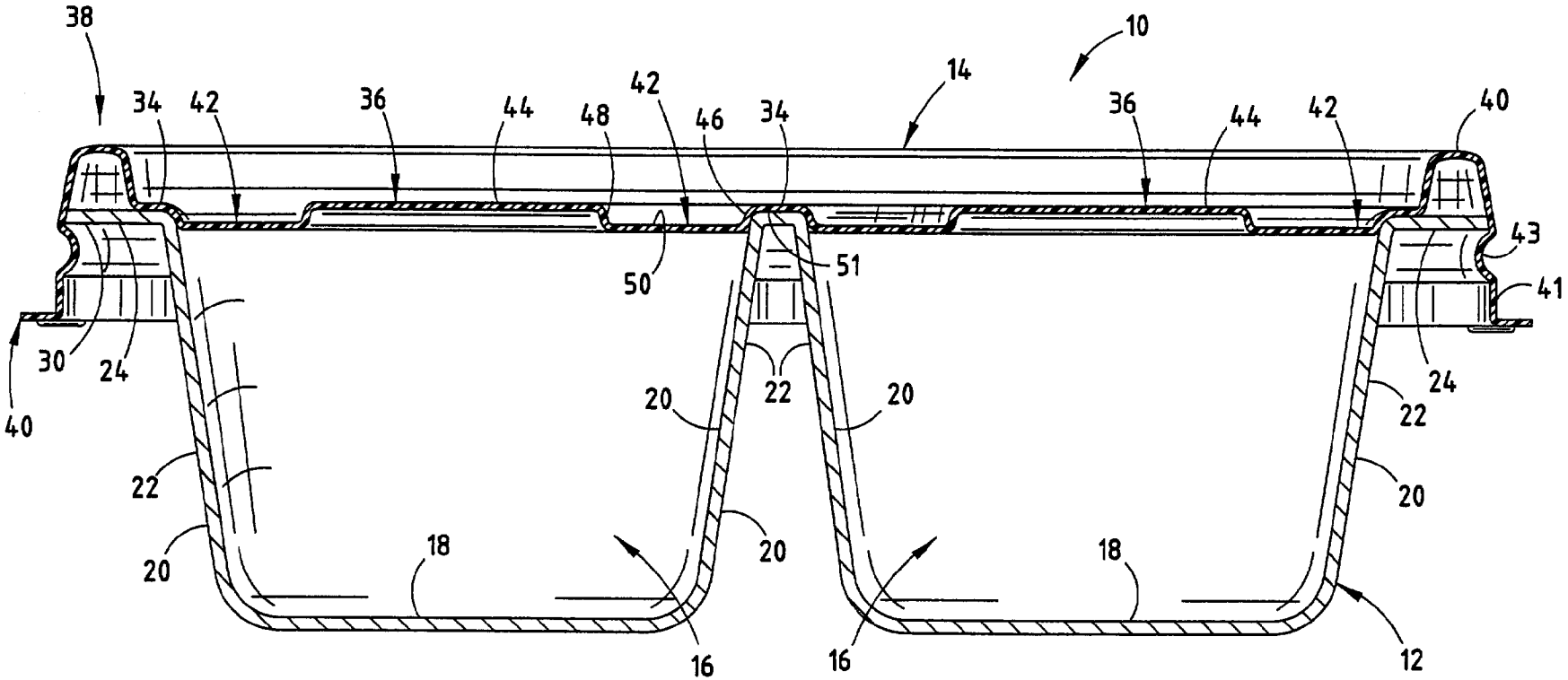
FIG. 7 is a cross-sectional view of the tray and the tray lid of the present invention taken along the line VII—VII of FIG. 3.

The illustrated tray lid 14 (FIGS. 1–7) includes a substantially flat tray covering section 32 designed to cover the food pockets 16 of the food tray 12 to maintain the food within the food pockets 16 when the tray lid 14 is connected to the food tray 12. The tray covering section 32 includes a wall covering portion 34 and pocket covering portions 36. Three pocket covering portions 36 are shown, with each pocket covering portion 36 being configured to overlie a food pocket 16 of the food tray 12. The wall covering portion 34 is located between each of the pocket covering portions 36 to thereby separate the pocket covering portions 36. The wall covering portion 34 also surrounds each of the pocket covering portions 36 and defines a border 38 of the tray lid 14. The border 38 of the tray lid 14 also has an inverted U-shaped ridge 40 having a depending L-shaped leg 41 (FIG. 7). The depending L-shaped leg 41 includes a concave indent 43 for connecting the tray lid 14 to the food tray 12. The tray lid 14 is preferably made out of PET polyester, although it is contemplated that the tray lid 14 can be made out of other materials.

In the illustrated example, the pocket covering portions 36 of the tray lid 14 include a U-shaped channel 42 defining a periphery of the pocket covering portions 36 and a central area 44 surrounded by the U-shaped channel 42. The U-shaped channel 42 has a first side wall 46 connected to the wall covering portion 24, a second side wall 48 connected to the central area 44 of the pocket covering portion 36 and a connecting portion 50 connecting the first side wall 46 and the second side wall 48. The U-shaped channel 42 keeps the food within the food pockets 16 of the food tray 12 within the individual food pocket 16 when the tray lid 14 is, connected to the food tray 12.

The illustrated pocket covering portions 36 of the food tray 14 abut against the slanted portion 22 of the food pockets 16 of the food tray 12 to maintain the food within the food pockets 16. As seen in FIG. 7, when the tray lid 14 is placed over the food tray 12, a bottom face 51 of the wall covering portion 34 overlies the top flat portion 24 of the wall 20 of the food tray 12. Additionally, the first side wall 46 of the U-shaped channel 42 partially overlies the slanted portion 22 of the wall 20 of the food tray 12. Therefore, the first side wall 46 of the U-shaped channel 42 abuts against the slanted portion 22 of the wall 20 of the food pockets 16 and does not allow the food within the food pockets 16 to escape the food pockets 16. Consequently, the food within the food pockets 16 can not commingle or escape to an adjacent food pocket 16, thereby securely maintaining food in the food pocket 16 of the food tray 12. Additionally, the tray covering section 32 of the tray lid 14 is preferably concave as seen from the top of the tray lid 14 in order to press down the tray covering section 32 when the tray lid 14 is connected to the food tray 12, thereby maintaining a more secure connection between the U-shaped channel 42 and the wall covering portion 34 of the tray lid 14 with the wall 20 of the food tray 12.

In the illustrated example, the L-shaped leg 41 of the tray lid 14 is positioned about the rim 24 of the food tray 12 to connect the tray lid 14 to the food tray 12. The L-shaped leg 41 includes the concave indent 43. The tray lid 14 is connected to the food tray 12 by snapping the tray lid 14 over the food tray 14 until the rim 24 of the food tray 12 is located above the concave indent 43. As seen in FIG. 7, once the tray lid 14 is connected to the food tray 14, the rim 24 of the food tray 12 will be locked in position between the concave indent 43 and the wall covering portion 34 of the tray lid 14 adjacent the rim 24.

It will be readily appreciated by those skilled in the art that modifications may be made to the invention without departing from the concepts disclosed herein. For example, although the food tray 12 and the tray lid 14 are shown as being substantially rectangular, it is contemplated that the food tray 12 and the tray lid 14 could have any configuration. Such modifications are to be considered as included in the following claims, unless these claims by their language expressly state otherwise.

We claim:

1. A tray lid for covering a food tray having at least one food pocket therein, comprising:

a substantially flat tray covering section including a wall covering portion and at least one pocket covering portion formed thereon;

the pocket covering portion having a central area and a periphery defined by a channel;

the channel including a first side wall connected to the wall covering portion, a second side wall connected to the central area of the pocket covering portion and a connection portion connecting the first side wall and the second side wall;

wherein a portion of a bottom face of the wall covering portion is adapted to overlie a top flat portion of a wall of the at least one food pocket of the tray and the first side wall of the channel is slanted and adapted to abut a slanted portion of the wall of the at least one food pocket of the tray along an entire height of the first side wall, thereby securely maintaining food in the at least one food pocket of the food tray when the tray lid is placed over the food tray; and wherein the first side wall and the second side wall extend upwardly from the connecting portion and the first side wall also extends outwardly away from the second side wall whereby a first connection point between the first side wall and the wall covering portion is farther away from the second side wall than a second connection point between the first side wall and the connecting portion;

wherein the wall covering portion has a border having an elongated ridge located along a side edge of the flat tray covering section for providing strength to the flat tray covering section; and the elongated ridge extends upwardly and from the bottom face of the wall covering portion such that the ridge will be above and spaced from the top flat portion of the wall of the at least one food pocket of the tray when the tray lid is connected to the tray.

2. The tray lid as defined in claim 1, wherein:

the flat tray covering section is substantially rectangular.

3. The tray lid as defined in claim 1, wherein:

the flat tray covering section includes at least two pocket covering portions.

4. The tray lid as defined in claim 3, wherein:

the wall covering portion is located between the at least two pocket covering portions and surrounds the at least two pocket covering portions; and a region of the wall covering portion surrounding the at least two pocket covering portions defines the border of the flat tray covering section.

5. The tray lid as defined in claim 4, wherein:

the border includes an indent adapted to snap over a flat rim of the food tray for connecting the tray lid to the food tray.

6. The tray lid as defined in claim 1, wherein:

the border has an indent adapted to snap over a flat the food tray for connecting the tray lid to the food tray.

7. The fray lid as defined in claim 1, wherein:

the channel is U-shaped.

8. A food carrier assembly comprising:

a food tray including at least one food pocket therein, the food tray further including a wall having a slanted portion defining sides of the at least one food pocket and a top flat portion defining a top of the food tray; and a tray lid for covering the food tray, the tray Ed including a substantially flat tray covering section having a wall covering portion and at least one pocket covering portion formed thereon, the pocket covering portion having a central area and a periphery defined by a channel, and the channel having a first side wall connected to the wall covering portion, a second side wall connected to the central area of the pocket covering portion and a connection portion connecting the first side wall and the second side wall;

wherein a bottom face of the wall covering portion overlies a top flat portion of the wall of the food tray and the first side wall of the channel is slanted and abuts a slanted portion of the wall of the food tray along an entire height of the first side wall when the tray lid is placed over the food tray, thereby securely maintaining food in the at least one food packet of the food tray when the tray lid is placed over the food tray; and wherein the first side wall and the second side wall extend upwardly from the connecting portion and the first side wall also extends outwardly away from the second side wall whereby a first connection point between the first side wall and the wall covering portion is farther away from the second side wall than a second connection point between the first side wall and the connecting portion:

wherein the wall covering portion has a border having an elongated ridge located along a side edge of the flat tray covering section for providing strength to the flat tray covering section; and the elongated ridge extends upwardly from the bottom face of the wall covering portion such that the ridge is above and spaced from the top flat portion of the wall of the at least one food pocket of the tray when the tray lid is connected to the tray.

9. The food carrier assembly as defined in claim 8, wherein:

the flat tray covering section is substantially rectangular.

10. The food carrier assembly as defined in claim 8, wherein:

the flat tray covering section includes at least two pocket covering portions.

11. The food carrier assembly as defined in claim 10, wherein:

the wall covering portion is located between the at least two pocket covering portions and surrounds the at least two pocket covering portions; and a region of the wall covering portion surrounding the at least two pocket covering portions defines the border of the flat tray covering section.

12. The food carder assembly as defined in claim 11, wherein:

the food tray includes a flat rim; and the border includes an indent adapted to snap over a flat rim of the food tray for connecting the tray lid to the food tray.

13. The food carrier assembly as defined in claim 8, wherein:

the food tray includes a flat rim; and the border has an indent adapted to snap over a flat rim of the food tray for connecting the tray lid to the food tray.

14. The food carrier assembly as defined in claim 8, wherein:

the channel is U-shaped.

15. A tray lid for covering a food tray having at least one food pocket therein, comprising:

a substantially flat tray covering section including a wall covering portion and at least one pocket covering portion formed thereon;

the pocket covering portion having a central area and a periphery defined by a channel;

the central area of the pocket covering portion and the wall covering portion being substantially parallel and co-planar; and the channel including a first side wall connected to the wall covering portion, a second side wall connected to the central area of the packet covering portion and a connection portion connecting the first side wall and the second side wall;

wherein a bottom face of the wall covering portion is adapted to overlie a top flat portion of a wall of the at least one food pocket of the tray and the first side wall of the channel is adapted to partially overlie a slanted portion of the wall of the at least one food pocket of the tray, thereby securely maintaining food in the at least one food pocket of the food tray when the tray lid is placed over the food tray; and wherein the wall covering portion has a border having an elongated ridge extending upwardly along a side edge of the flat tray covering section end from the bottom face of the wall covering portion such that the ridge will be spaced from the top flat portion of a wall of the at least one food pocket of the tray when the tray lid is connected to the tray, the ridge for providing strength to the flat tray covering section.

16. The tray lid as defined in claim 15, wherein:

the flat tray covering section includes at least two pocket covering portions;

the wall covering portion is located between the at least two pocket covering portions and surrounds the at least two pocket covering portions; and a region of the wall covering portion surrounding the at least two pocket covering portions defines the border of the flat tray covering section.

17. The tray lid as defined in claim 16, wherein:

the border includes an indent adapted to snap over a flat rim of the food tray for connecting the tray lid to the food tray.

18. A food carrier assembly comprising:

a food fray including at least one food pocket therein, the food tray further including a wall having a slanted portion defining sides of the at least one food pocket and a top flat portion defining a top of the food tray; and a tray lid for covering the food tray, the tray lid including a substantially flat tray covering section having a wall covering portion and at least one pocket covering portion formed thereon, the pocket covering portion having a central area and a periphery defined by a channel, the central area of the pocket covering portion and the wall covering portion being substantially parallel and co-planar, and the channel having a first side wall connected to the wall covering portion, a second side wall connected to the central area of the pocket covering portion and a connection portion connecting the first side wall and the second side wall;

wherein a bottom face of the wall covering portion overlies a top flat portion of the wall of the food tray and the first side wall of the channel partially overlies a slanted portion of the wall of the food tray when the tray lid is placed over the food tray, thereby securely maintaining food in the at least one food pocket of the food tray when the tray lid is placed over the food tray; and wherein the wall covering portion has a border having an elongated ridge extending upwardly along a side edge of the flat tray covering section and from the bottom face of the wall covering portion such that the ridge is above and spaced from the top flat portion of a wall of the at least one food pocket of the tray when the tray lid is connected to the tray.

19. The food carrier assembly as defined in claim 18, wherein:

the food tray includes a flat rim; and the border includes an indent adapted to snap over a flat rim of the food tray for connecting the tray lid to the food tray.

* * * * *

UNITED STATES PATENT AND TRADEMARK OFFICE

CERTIFICATE OF CORRECTION

PATENT NO. : 7,114,630 B2
APPLICATION NO. : 10/222569
DATED : October 3, 2006
INVENTOR(S) : Paul T. Dege et al.

It is certified that error appears in the above-identified patent and that said Letters Patent is hereby corrected as shown below:

Column 5
Claim 7, line 22, “fray” should be --tray--.
Claim 8, line 29, “tray Ed” should be --tray lid--.

Column 6
Claim 12, line 13, “carder” should be --carrier--.
Claim 15, line 40, “packet” should be --pocket--.

Column 7
Claim 18, line 6, “fray” should be --tray--.

Signed and Sealed this

Twenty-seventh Day of March, 2007

JON W. DUDAS
*Director of the United States Patent and Trademark Office*